United States Patent [19]

Kalogeros

[11] Patent Number: 4,669,959

[45] Date of Patent: Jun. 2, 1987

[54] BREACH LOCK ANTI-ROTATION KEY

[75] Inventor: Robert R. Kalogeros, Glastonbury, Conn.

[73] Assignee: United Technologies Corporation, Hartford, Conn.

[21] Appl. No.: 633,721

[22] Filed: Jul. 23, 1984

[51] Int. Cl.[4] ..... F01D 5/32

[52] U.S. Cl. ..... 416/221; 416/198 A; 415/199.5

[58] Field of Search ..... 416/220 R, 221, 9.5, 416/144, 198 A, 193 A, 200 A, 201 R; 415/199.5

[56] References Cited

U.S. PATENT DOCUMENTS

| | | | |
|---|---|---|---|
| 2,985,426 | 5/1961 | Hunter et al. | 416/97 R |
| 2,998,959 | 9/1961 | Haworth et al. | 416/193 A X |
| 3,043,562 | 7/1962 | Van Nest et al. | 416/221 |
| 3,096,074 | 7/1963 | Pratt et al. | 416/221 X |
| 3,297,302 | 1/1967 | Spears | 416/144 |
| 4,192,633 | 3/1980 | Herzner | 416/221 |
| 4,470,756 | 9/1984 | Rigo et al. | 416/220 R |
| 4,470,757 | 9/1984 | Vollinger | 416/219 R X |
| 4,523,890 | 6/1985 | Thompson | 416/221 X |

FOREIGN PATENT DOCUMENTS

| | | | |
|---|---|---|---|
| 805371 | 12/1958 | United Kingdom | 416/144 |

*Primary Examiner*—Everette A. Powell, Jr.
*Attorney, Agent, or Firm*—Norman Friedland

[57] ABSTRACT

The anti-rotational breach lock comprises a full ring of equally spaced dogs slideably engaging complementary lugs extending from the disk restrain the blades axially. A key fits any space between lugs and has an in situ bent tab nested between the key and ring that engages the back and front end of the ring to lock the key into place. Because the key can fit anywhere around the circumference of the disk and as many keys as spaces can be deployed, the key may serve to balance the rotor.

3 Claims, 3 Drawing Figures

BREACH LOCK ANTI-ROTATION KEY

CROSS REFERENCE

This invention is related to the inventions disclosed in copending patent applications entitled TURBINE SIDE PLATE ASSEMBLY, Ser. No. 633,722, ROTATING SEAL FOR GAS TURBINE ENGINE, Ser. No. 633,723 and TURBINE COVER-SEAL ASSEMBLY Ser. No. 633,727, filed by Robert R. Kalogeros, Gary P. Peters, and Robert R. Kalogeros and Gary F. Chaplin, respectively on even date and all assigned to the same assignee of this application.

DESCRIPTION

1. Technical Field

This invention relates to turbines for gas turbine engines and particularly to the lug of a breach lock which lock is the axial restraint of the turbine blades in the turbine disk.

2. Background Art

The patent application entitled ROTATING SEAL FOR GAS TURBINE ENGINE filed by Gary Paul Peters on even date, supra discloses an invention that constitutes an improvement over the lenticular seal disclosed and claimed in U.S. Pat. No. 3,733,146 granted to S. L. Smith & P. E. Voyer on May 15, 1973 and assigned to the same assignee as this patent application. This patent discloses a toroidally shaped seal disposed between the 1st and 2nd turbine and is lenticular in cross section. Essentially, the inner and outer curved plates form an elliptical body that has its narrow ends abut against the adjacent disks of the turbines or the side plates thereof. This, in fact, forms a point attachment in cross section, and a circumferential edge attachment in full, being supported radially by the turbine disks and transmitting the axial load through both curved plates. In operation, the plates achieved their results, that is, net reduced stress, by virtue of the bending of the plates. Obviously, the higher the bending loads the heavier the plates have to be so as to tolerate the higher bending stresses. The seal disclosed in the patent application, supra, is an "I" Beam shaped, in cross section seal, where the outer rim spans between adjacent stages of turbines and engage the disks in a judicial manner. Thus, the seal in the aforementioned patent application and Pat. No. 3,733,146 serve to restrain the second turbine in an axial forward direction. The rear restraint is typically a ring with means such as a breach lock to lock it in position. A lock of the breach type is disclosed in U.S. Pat. No. 3,096,074 granted to L. J. Pratt et al on July 2, 1963. In that patent a ring with a plurality of dogs is inserted in a recess with complementary dogs. The ring is rotated to line the dogs in juxtaposition. A key is inserted into a specially designed recess vacated by the dog when rotated in engagement and the tab on the key mates with a lug on the plate locates the key circumferentially with respect to the disk and the plate with respect to the disk.

It is typical in heretofore designs to utilize balancing weights to be added to a flange on the disk so as to dynamically balance the rotor.

I have found that I can perform both functions with the use of this invention which essentially is a specifically designed key that inserts into the vacated slot between the seal ring and disk and includes a separate tab nested under the key and extends in back of the seal plate and is bent in situ to bear against the front of the seal plate. Inasmuch as a key will fit any of the vacated recesses and there being a recess for each of the lugs (or dogs) on the disk, the key can be judiciously located around the circumference to balance the rotor. The amount of metal of the tab can be selected to enhance the tuning of the rotor.

DISCLOSURE OF INVENTION

An object of this invention is to provide for a rear seal plate of a turbine stage having a breach or bayonet lock on improved key locking means. A feature of this invention is that the key fits any of the spaces between lugs so as to provide a balancing feature. Additional balancing is afforded by the tab sandwiched between the key and disk.

Other features and advantages will be apparent from the specification and claims and from the accompanying drawings which illustrate an embodiment of the invention.

BEST MODE FOR CARRYING OUT THE INVENTION

Figure 1:
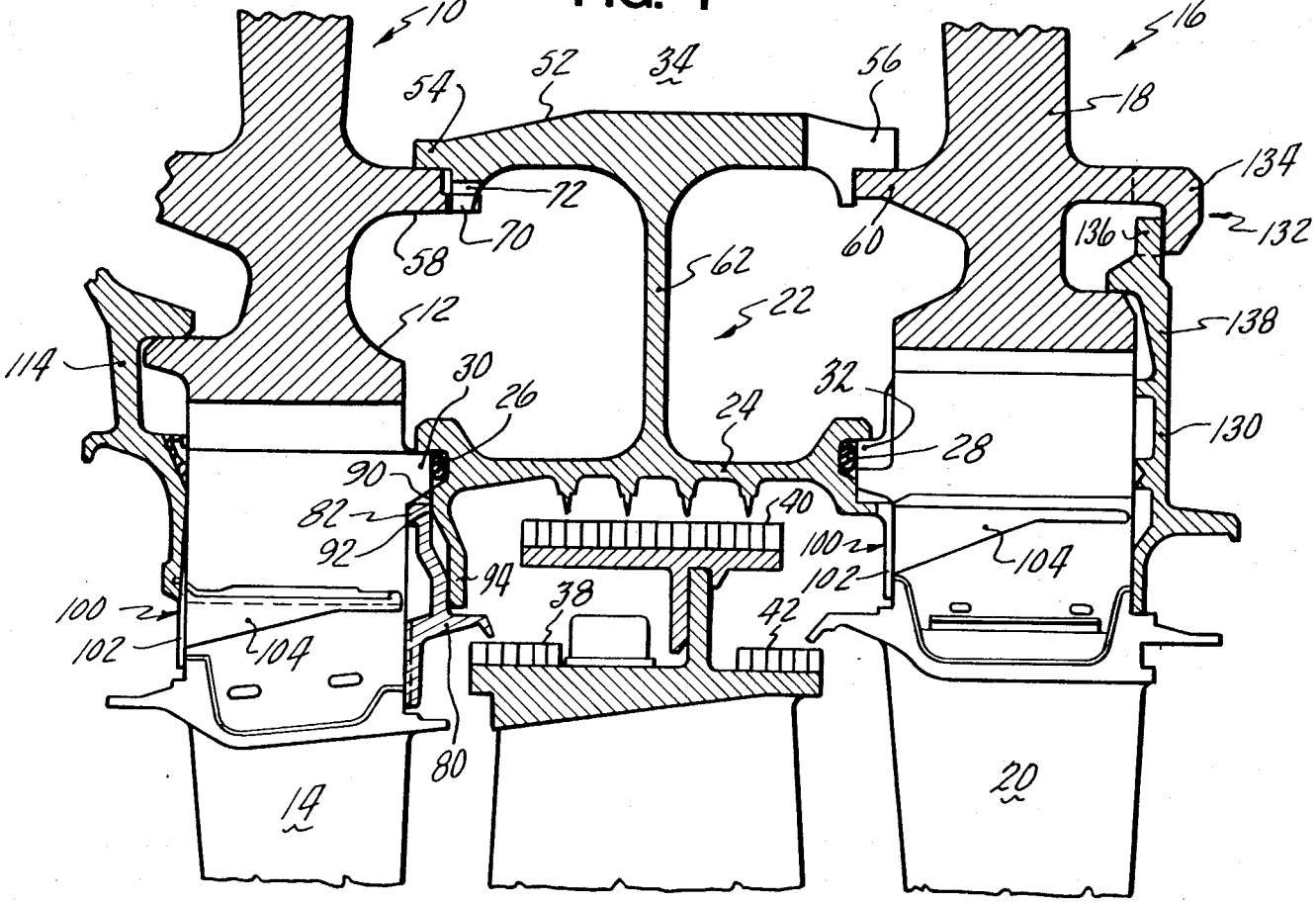
FIG. 1 is a partial view of the 1st and 2nd stages of the turbine of a gas turbine engine in cross section showing the improved rear side plate and its retention system.

This invention is particularly suitable as the breach lock for the rear rim seal for the turbine rotors of a gas turbine power plant such as the engine models JT-9D, PW2037 and PW4000 manufactured by Pratt & Whitney Aircraft of United Technologies Corporation, the assignee of this patent application, the details of which are incorporated herein by reference. As best seen from FIG. 1, 2 & 3, the first stage turbine generally illustrated by reference numeral 10 comprises a rotor disk 12 and a plurality of circumferentially spaced turbine blades 14 (only a portion being shown) suitably supported thereby. Likewise, the 2nd stage turbine generally illustrated by reference numeral 16 comprises a rotor disk 18 and a plurality of circumferentially spaced blades 20 (only a portion being shown) suitably supported thereby. Although not shown, it will be appreciated that both the 1st and 2nd stage turbines are coupled to a common shaft (not shown) and serve to extract energy from the engine's fluid working medium and transfer said energy in terms of R.P.M. to the engine's shaft.

As noted, the I-Beam (in cross section) seal generally indicated by reference numeral 22 comprises an outer rim 24 spanning between the rear of the disk 12 and the front of disk 18 and is configured so that the general shape is generally concentric to the engine's centerline. Annular O-type seals 26 and 28 bear against the axial projections 30, and 32 respectfully to minimize leakage from the gas path that is outboard of the seal in the vicinity of the blades 14 and 20.

From the foregoing it is apparent that the rim 24 together with "O" seals 26 and 28 serve to seal the cavity 34 from the engines working fluid medium. Leakage around the blades adjacent the stator 36 are minimized by the labyrinth seals 38, 40 and 42. Similar to the lenticular seal in the U.S. Pat. No. 3,733,146, supra, the knife edges bear against the complimentary lands formed from honeycomb material when in the rotating mode and serve the same sealing function. Labyrinth seals are well known and are not a part of this invention.

As noted above, the upper rim 24 not only serves to support the knife edges of the labyrinth seal it provides axial stiffness to the 2nd stage turbine so as to tune it for the vibrating field to which it is subjected.

The inner rim 52 is slightly coned to form a convexed surface, the outer edges 54 and 56 underlie axial projections 58 and 60 and are snapped into place upon assembly. A flat annular plate or disk 62 support the inner rim and outer rim and in cross section resemble an "I" Beam. The rim 52 serves to take up the radial loads passing some of the radial stresses through the disks via the axial projections 58 and 60 and some through the flat plate 62. The flat plate 62 by virtue of this construction serves to minimize or control the growth of the knife edges on the outer rim 24.

The radial restraints 54 and 56 also serve to control the average tangential stress in the seal 22 for burst considerations and control local tangential stress for low cycle fatigue considerations.

The dimensions between the axial projection 60 on turbine disk 18 and the restraint 56 is selected to allow a leakage path from cavity 34 into the cavity between flat plate 62 and turbine disk 18 so as to balance the pressure across the flat plate 62. Obviously, because the cavity between plate 62 and the first turbine is in proximity to the first turbine where the pressure is highest, it tends to see a higher pressure than that which is on the opposing side. The gap provided adjacent restraint 56 tends to bleed pressure therein so as to balance these forces. While not preferred, this pressure differential could be alleviated further by locating holes within flat plate 62 itself.

Antirotation lugs 70 formed on disks 12 and 72 formed on rim 52 cooperate to prevent relative rotation to the turbine disks and seal in the event of a malfunction. The lenticular seal described in U.S. Pat. No. 4,332,133 supra contained a similar function.

The rear side plates 80 are nested to underlie the overhang portion 30 of disk 12 which serves as the radial restraint. Each of the side plates 80, there being one for each blade, is formed from a generally flat element having a fir tree shaped portion 82 that is sized to fit into the fir tree slot of the disk that is supporting the turbine blade. Obviously, each side plate 80 is assembled end to end to circumscribe the disk 12 at the juncture where the blade fits into the disk. The outer edge of the outer rim 24 abuts against the face of each of the rear side plates 80 at the lower edge 92 to provide the axial restraint. The hammer head 94 extending from rim 24 may provide additional restraint. Obviously, these radial and axial restraints are the only mechanical connections that retain each of the rear side plates 80 in position.

The cover-seals generally illustrated by reference numeral 100 comprises a front plate 102 formed from a relatively flat member and fits flush against the face of the turbine disk 12 and 18, and an axial extending portion 104. Similar to the rear side plates, a plurality of these elements are mounted end-to-end around the circumference of the disk at the juncture where the root of the turbine blade fits into the disk broach.

Figure 2:
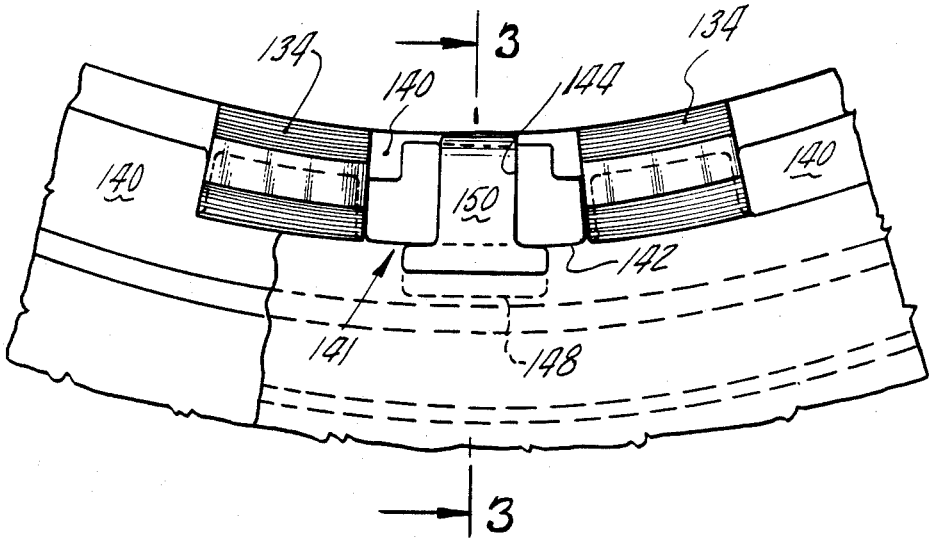
FIG. 2 is a partial view in elevation illustrating the seal plate assembled to the disk with the key in position.

In accordance with this invention and as best seen in FIGS. 1 & 2 the rear seal plate 130 bears against the disk 18 of the 2nd stage turbine and carries a breach or bayonet lock generally indicated by reference numeral 132. The breach lock comprises a plurality of circumferentially spaced lugs 134 (one being shown in FIG. 1) extending around the circumference of disk 18. The spacing is symmetrical and the width between lugs is identical. Complementing, these lugs are dogs 136 (one being shown in FIG. 1) extending from the seal ring body 138 and when deployed are in juxtaposition with the face of the lug 134; There being a dog 136 matching each of the lugs 134. The width of the dog is equal to or smaller than the width of the space 140 between lugs 134. Thus,to assemble the dogs of the seal plate, which is annular in shape, fit into the space between lugs and rotated until the dogs and lugs line-up tandemly. Hence, the seal plate locks into the disk restraining the turbine blades 20 axially in the rearward direction.

Figure 3:
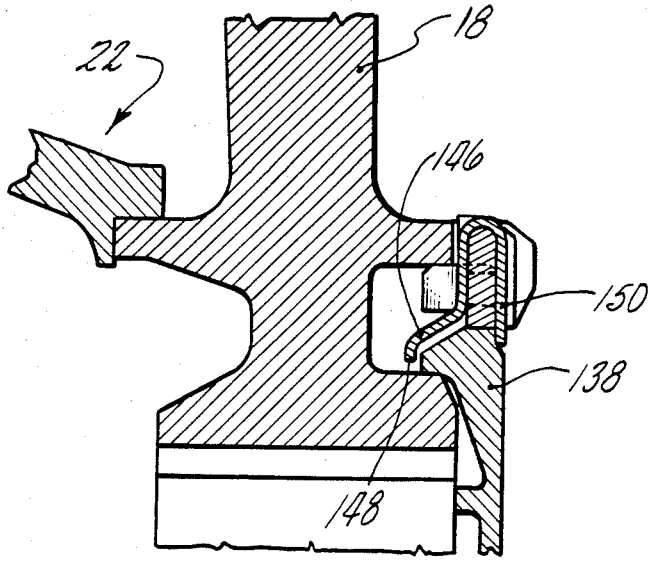
FIG. 3 is a partial view in section and taken along lines 3-3 of FIG. 2.

What has been described immediately above is a typical breach lock configuration. The key of the breach lock is the essence of this invention. The key generally indicated by reference numeral 141 has a body portion 142 that is dimensioned to fit into the space 140 between adjacent lugs vacated by the dogs when deployed. A slot 144 extending around three sides of body 142 centrally thereof (see FIGS. 2 & 3) receives a sheet metal tab 146 having one free end 148 extending behind the seal plate 138 and a front end 150. To assemble, the front end 150 of tab 146 is unbent and fitted into the slot 144 but only into two sides of the body 142; the rear and top side (as viewed in FIG. 3). Once inserted into the space 140, the front portion of tab 146 is bent, in situ, to fit into the front slot retaining the key axially. As is apparent from the foregoing, the key prevents the dogs from rotating back into the space between lugs and hence restrains the rear seal plate circumferentially. Because the key can fit into any of the spaces between lugs, the key can be utilized to dynamically balance the rotor as they replace the heretofore used balancing weights. Also, since the size of tab 146 can be varied significantly it can also be utilized to fine tune the balancing of the rotor.

It should be understood that the invention is not limited to the particular embodiments shown and described herein, but that various changes and modifications may be made without departing from the spirit and scope of this novel concept as defined by the following claims.

I claim:

1. For a gas turbine engine having a rotor comprising a disk and a plurality of turbine blades circumferentially spaced in recesses formed on the outer circumference of said disk, a breach-lock formed from an annularly shaped member having a plurality of dogs extending from an edge of said member, uniformly spaced complementary lugs extending from said disk for engagement with said dogs for axially restraining said turbine blades in said disk and defining uniform spaces between adjacent lugs, at least one removable key having a generally rectangular shaped body dimensioned to fit into any one of said uniform spaces and circumferentially restraining said annularly shaped member to lock it into place, and a tab formed from sheet metal members sandwiched between said body and said annular shaped member having one portion extending behind said annular shaped member and another portion extending in front of said annular shaped member and bent in situ to engage the front of said annular shaped member to secure said key in place.

2. For a gas turbine engine as in claim 1, wherein said rectangularly shaped body has a continuous slot formed on at least 3 sides for receiving said tab.

3. For a gas turbine engine as in claim 2 wherein the number of said tabs fitted into said uniform spaces are selected to dynamically balance said rotor.

* * * * *